US005351357A

United States Patent [19]

Liberman

[11] Patent Number: 5,351,357

[45] Date of Patent: Oct. 4, 1994

[54] SPREADER TOOL FOR APPLYING BONDING COMPOUNDS TO PLANAR SURFACES

[75] Inventor: Isak Liberman, Des Plaines, Ill.

[73] Assignee: Aasak Enterprises, Ltd., Northbrook, Ill.

[21] Appl. No.: 922,795

[22] Filed: Jul. 31, 1992

[51] Int. Cl.[5] ..... A47L 11/38

[52] U.S. Cl. ..... 15/245.1; 15/245

[58] Field of Search ..... 15/117, 245, 245.1, 15/105, 111, 114, 118, 112.1, 250.36, 250.41, 236.02

[56] References Cited

U.S. PATENT DOCUMENTS

| | | | |
|---|---|---|---|
| 3,089,173 | 5/1963 | Hunt | 15/245 |
| 4,075,730 | 2/1978 | Siemund | 15/245 |
| 4,430,769 | 2/1984 | Bergstrom | 15/245 |
| 4,654,919 | 4/1987 | Liberman | 15/245.1 |
| 4,941,228 | 7/1990 | Belanger | 15/245 |
| 4,946,360 | 8/1990 | Brown | 15/245.1 |

FOREIGN PATENT DOCUMENTS

| | | | |
|---|---|---|---|
| 2219620 | 12/1989 | United Kingdom | 15/245.1 |

*Primary Examiner*—Timothy F. Simone
*Assistant Examiner*—Terrance R. Till
*Attorney, Agent, or Firm*—Patula & Associates

[57] ABSTRACT

An improved tool for spreading bonding compound, or the like, on planar surfaces which, in a first embodiment, includes a contoured surface having two end tip portions and a midportion contained in a plane spaced between the end tip portions. The tool includes a back which gives structural integrity to the tool, and a flexible application outer edge connected to the application face. In use, the bonding compound is applied to the planar surface, and the projecting flexible outer edge of the application face is forced against the wall and pulled along to obtain a flat surface to spread the plaster out along the planar surface to spread the bonding compound evenly and smoothly over the planar surface. The flexible outer edge can be removable and replaceable for adjusting to varying surfaces and for easy maintenance.

19 Claims, 3 Drawing Sheets

SPREADER TOOL FOR APPLYING BONDING COMPOUNDS TO PLANAR SURFACES

The present invention is directed to an improved tool for spreading compound such as dry wall compound, plaster, cement, spackle, grout, bond compound or the like, upon generally flat planar surfaces such as drywall, tile, vertical wall, or horizontal surfaces and, more particularly, using spreader tools that have improved formations applying and spreading compound to such surfaces with minimal manual effort and maximum smoothing effect.

BACKGROUND OF THE INVENTION

In the finishing operations of drywall construction, tape is usually applied between adjacent pieces of drywall. Thereafter, compound such as plaster or joint compound is spread over the tape covering the drywall seams and over adjacent portions of the adjoining drywall pieces, to thereby fuse together the previously separate sections of drywall. Thereafter, in the usual fashion, joint compound or the like is applied over the remainder drywall surface area, where needed, to provide a finished product.

The conventional tool for the application of the joint compound over the tape adjoining adjacent drywall pieces has been a simple flat, straight knife made of metal. In using this conventional knife in the application and spreading of the joint compound over the tape and adjoining drywall segments, a multiple-step operation is necessary. The multiple-step operation has been necessitated by the fact that the knife in current use must be used to apply a large amount of the joint compound on the drywall segments, thereafter spreading it in an uneven fashion and, after that, smoothing it out which, by itself, takes usually two or more separate operations of sanding and spreading more compound to refill shrinkage of the previously applied layer of compounds. Thus, the actual spreading of the joint compound or the like over the tape, adjacent drywall segments, and the rest of the drywall as needed, has been tedious, time consuming and a multiple-step operation.

The very same knife that has been used to apply the joint compound or the like to the tape and adjoining wall portions has also been used to apply spackle to fill in cracks in a wall or ceiling before the painting of the surfaces. This also is a time consuming and multi-step operation, in the same manner as the above-described application of joint compound to drywall. In the application of the spackle to a crack, what is most important is to fill the crack with the spackle, and to thereafter insure that the wall portions adjacent on either side of the crack are made smooth. Using the conventional knife, this has been, as described above, a difficult task, since the application of the spackle is not done consistently and evenly over the crack and adjoining wall portions thereto.

U.S. Pat. Nos. 4,731,258 and 4,654,919 disclose the tool and method for spreading joint compound, cement or spackle on planar surfaces including drywall, upon which the present improvement invention is based. These patents teach the use of a spreader tool having two surfaces, a flat surface and a concave surface. The present invention improves upon the prior art by providing a flexible application edge, variable spreader surface rigidity, and an improved surface curvature to enhance single application compound use, and to improve upon the utility and maintenance features of the prior art spreader tools. Additionally, the flexible application edge can be removable and replaceable to adjust to varying surfaces and varied compound spreading needs.

SUMMARY OF THE INVENTION

The main objective of the present invention is to provide an improved tool for spreading compound such as drywall compound, plaster, cement, and spackle to planar surfaces such that the amount of time required to do so is considerably shortened, the number of steps in order to accomplish the spreading is considerably reduced, and the use and maintenance of the tool is improved.

Another objective of the present invention is to provide such a spreading tool for the application of compound such as drywall joint compound, cement, plaster and spackle to planar surfaces such that it may be done in a very simple, easy and efficient manner.

Still another objective of the present invention is to provide an improved spreading tool for applying compound such as drywall joint compound, plaster, cement and spackle to planar surfaces such that the actual spreading and smoothing out may be accomplished in substantially one independent step.

Another objective of the present invention is to provide an improved spreading tool having a flexible application edge for applying bonding compound to a wide variety of planar surfaces, which edge may also be removable and replaceable to work on varying surfaces and with various compounds.

Yet another objective of the present invention is to provide such a spreading tool that is easy to manufacture, easy to use repeatedly, easy to clean after use, that is durable and long lasting, lightweight, not susceptible to damage upon dropping, and rust proof.

It is another objective of the present invention to provide an improved spreading tool for the application of compound such as drywall joint compound, cement, plaster, or the like on flat wall surfaces in order to finish them in a faster, easier and more expedient manner.

Still another object of the present invention is to provide an improved spreading tool for applying compound to planar surfaces including but not limited to drywall using drywall or joint compound, plaster, spackle, durabond or the like, to automobiles using such compounds as bondo or to cement surfaces using cement, foundation, floor or pavement compounds.

Toward these and other ends, the spreading tool of the present invention is provided in a first embodiment thereof with an applicator having a concave face and a back face, said applicator having a removable resilient outer edge connected thereto. Bonding compound or the like is applied to the planar surface using the applicator. The curvature of the concave face allows for the application of a substantial amount of bonding compound to the planar surface, concentrated in the middle, which thereafter may be applied by one stroke and smoothed out by pressing in along the concave face, so that the removable outer edge of the applicator substantially takes a flat planar shape to, thus firstly spread out the bonding compound during any stroke of the tool thereof and, at the same time, distribute the bonding compound in a uniform and smooth manner over the planar surface. The applicator preferably is made of rigid plastic, with the removable outer edge preferably being made of a flexible resinous material or plastic. The removable outer edge is integrally molded to form a stepped configuration having a flange which cooperatively associates with the applicator at its outer edge end. The removable outer edge is inserted into rigid yet removable interlocking fit with the outer edge end of the applicator, whereby the flexible outer edge assumes the concave formation of the applicator. The applicator has a handle for gripping. The applicator may also be made of an appropriate pliable metal that may yield to planar form upon the application of sufficient force in the manner described above.

BRIEF DESCRIPTION OF THE DRAWING

The invention will be more readily understood with reference to the accompanying drawings, wherein.

DETAILED DESCRIPTION OF THE INVENTION

Figure 1:
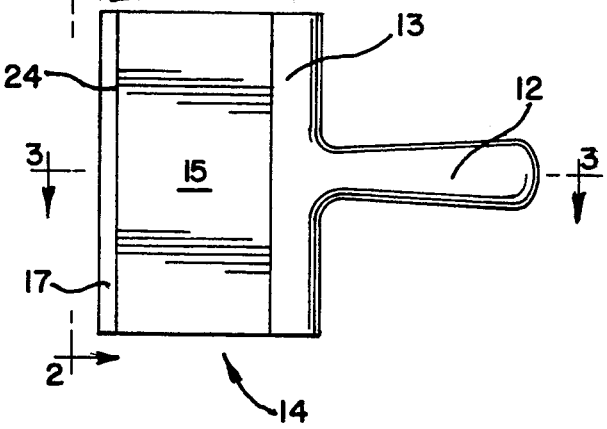
FIG. 1 is a top plan view of the spreader tool of the center crown embodiment of the present invention.

Referring now to the drawings in greater detail, the spreading tool for spreading compound such as drywall joint compound, plaster, and the like, on a planar surface such as drywall is indicated generally by Reference Numeral 10 in FIGS. 1 through 12. The tools shown in FIGS. 1 through 12 constitute the preferred embodiments of the present invention.

Figure 2:
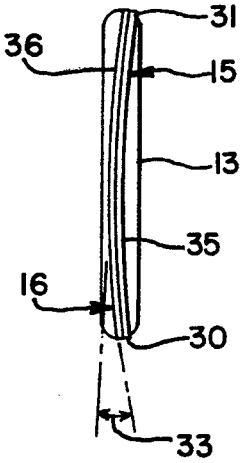
FIG. 2 is a side elevational view taken along line 2—2 of FIG. 1.
Figure 3:
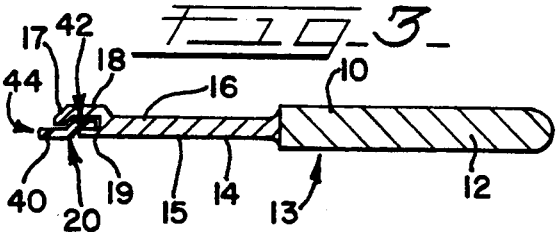
FIG. 3 is a cross-sectional view taken along line 3—3 of FIG. 1.

In FIGS. 1 through 3, the tool 10 includes a handle 12 formed in the conventional manner by which a hand may grip the tool 10. The forward front portion 13 of the handle 12 mounts the applicator 14 having an application face or a concave face 15 and a back face 16, both of which are fixedly mounted within the front portion 13 of the handle 12, as clearly shown in FIG. 3. The applicator 14 is integrally molded to form the concave face 15 and the back face 16. The outer edge end 17 of the applicator 14 projects outwardly as shown in FIGS. 1 and 3, and is comprised of a long arm 18, a short arm 19, and a cavity 20 between said arms 18 and 19. The removable outer edge 40 is of generally linearly stepped configuration (as shown in FIG. 3) and is cooperatively associated with said outer edge end 17 by inserting the cavity end 42 of said outer edge 40 into the cavity 20 of outer edge end 17, as shown in FIG. 3. The exterior face 44 of the removable outer edge 40 and the arms 18 and 19 of the outer edge end 17 constitute the drywall compound plaster, cement or spackle smoothing surface for applying same to drywall segment or the like. The applicator 14 is made of a rigid material, preferably plastic, although an appropriate metal may also be used. The removable outer edge 40 is made of a flexible plastic such as $\frac{1}{8}$ inch silicon rubber urethane, although a resilient metal may be used.

Each of the faces 15 and 16 is curved such that, when viewing FIG. 1, each face 15 and 16 projects out of the plane of the page. For purposes of description, such curvature shall be termed concave, since it is being viewed from above the plane of FIG. 1. In FIG. 2, such curvature is clearly shown. The center of the curvature for each of the faces 15 and 16 is about a plane substantially dividing the handle 12 longitudinally thereof when viewing FIG. 1. Such plane projects perpendicularly to the surface shown in FIG. 1 and into the page thereof. While, for purposes of description, the curvature of the faces 15 and 16 has been described as concave, it is to be understood that such curvature need not be perfectly concave, but may be meniscus-shaped or the equivalent thereof, as long as there is an offset from the central longitudinal portion of the applicator 14 as compared to the end tips 30 and 31 thereof. This allows for the outer edge end 17 and the inserted outer edge 40 to be flexed inwardly upon sufficient pressure thereto via handle 12, so that the central longitudinal portion 33 lies co-planar with the end tips 30 and 31 thereof when applying the plaster or the like to drywall in order to spread it out evenly, to this form a flat edge-surface. The midsection of the concave face 15 is indicated by Reference Numeral 35 in FIG. 2, while the midsection of the back face 16 is indicated by Reference Numeral 36 in FIG. 2. Thus, it is within the scope and purview of the present invention to provide a center crown curvature of the applicator 14 and faces 15 and 16 that are parabolic or of other arcuate extension.

When using the improved spreading tool of FIGS. 1 through 3, the bonding compound, or the like, is first placed upon the concave face 15 of the applicator 14. The concave face 15 of the applicator 14 is placed against a planar surface such as drywall at the portion thereof where the tape has been applied, or where the crack is located, and the handle 12 is used to force the tool 10 inward toward the concave face 15, so that the midsection 35 thereof becomes co-planar with the end tips 30 and 31 of the applicator 14 and co-extensive therewith to form a flat, projecting surface. Thereafter, the tool 10 is dragged along the drywall surface, either vertically or horizontally or a combination thereof, with the application of sufficient pressure causing the outer edge 17 and the outer edge 40 to force the plaster to fill in the crack or to cover the tape that had been applied, while simultaneously causing the plaster lying directly adjacent to the outer edge 40 to be forced to spread outwardly from the midsection 35 of the concave face 15, toward the end tips 30 and 31, to cause it to be smooth and evenly distributed, all in one stroke. Thus, with just one stroke, the bonding compound is applied to the planar surface directly over a crack or tape, and is simultaneously spread out in an even and smooth manner. Thus, no additional applications or strokes of the tool are necessary to accomplish the application-spreading of the plaster at a crack or at a portion at which tape has been applied. The applicator 14 is of sufficient stiffness and strength so as to prevent the flattening of the concave face 15 other than at the outer edge end 17 and outer edge 40 by which the joint compound or the like is applied over the area to be worked and spread out smoothly therefrom. Regarding the curvature of the applicator 14, such may take different forms as described above, with preferably the angle indicated by Reference Numeral 33 in FIG. 2 generally falling within the range of between 3 and 15 degrees, the angle 33 being subtended by the tangent to the mid-section portion 35 of the concave face 15 and a tangent to the end tip 30 of the same concave face 15, as shown in FIG. 2. The applicator 14 is made preferably of a rigid plastic, although metal may also be used. Flexible outer edge 40 is easily removed from applicator 14 for cleaning or replacement after or between uses.

Figure 4:
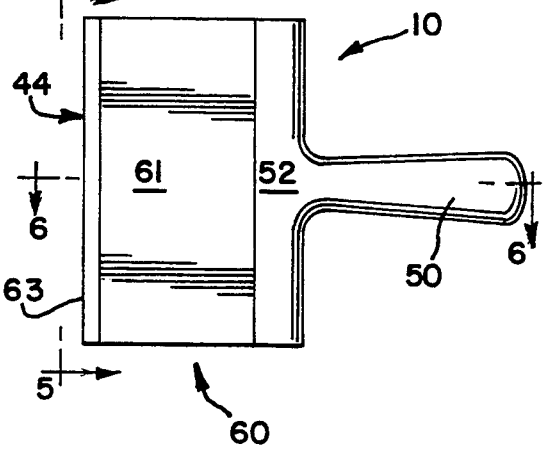
FIG. 4 is a top plan view of an alternate, end crown embodiment of the spreader tool of the present invention.
Figure 5:
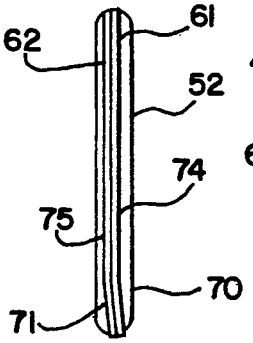
FIG. 5 is a side elevational view taken along line 5—5 of FIG. 4.
Figure 6:
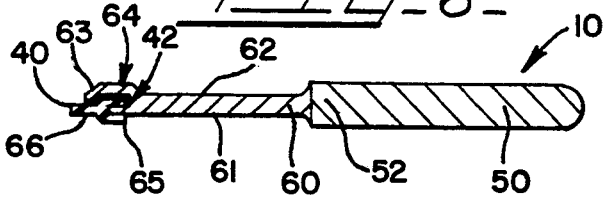
FIG. 6 is a cross-sectional view taken along line 6—6 of FIG. 4.

FIG. 4 through 6 show an alternate embodiment of the invention. FIGS. 4 through 6 show a handle portion 50 and an applicator 60 having a concave face 61 and a back face 62. The back face 62 is integrally molded to the concave face 61 and the front portion 52 of the handle 50, but differs from the embodiment of FIGS. 1 through 3 in its blade curvature. The outer edge end 63 of the applicator 60 projects outwardly as shown in FIGS. 4 and 6, and is comprised of a long arm 64, a short arm 65, and a cavity 66 between said arms 64 and 65. The removable outer edge 40 is of generally Y-shaped configuration (as shown in FIG. 6) and is cooperatively associated with said outer edge end 63 by inserting the cavity end 42 of said outer edge 40 into the cavity 66 of outer edge end 63, as shown in FIG. 6.

The exterior face 44 of the removable outer edge 40 serves the same smoothing surface function as associated with arms 64 and 65 in the FIGS. 4–6 embodiment as it does in the FIGS. 1–3 embodiment, but for the unique blade curvature of the respective embodiments. In FIGS. 4–6, each of the faces 61 and 62 is curved such that, when viewing FIG. 4, only approximately half of the faces 61 and 62 are contoured or curved, thereby forming an end crown as opposed to the center crown shown in FIGS. 1–3. The end crown curvature of FIGS. 4–6 is depicted by Reference Numerals 70 and 71 in FIG. 5. Although in FIG. 5 it is shown that the curvature of each of the faces 61 and 62 of the laminate starts a distance somewhat spaced from the midsections 74 and 75 of faces 61 and 62, respectively, it is within the scope and purview of the present invention to allow such curvature from the substantial mid-longitudinal section of each respective layer, in a manner shown in FIG. 2 of the first embodiment. The embodiment of the invention shown in FIGS. 4–6 is particularly advantageous for use in corner applications of compound whereby the end crown 70 and 71 of the applicator 60 applies compacted compound toward an inside corner without mess or interference with the intersecting wall. Additionally, the embodiment of the invention depicted by FIGS. 4–6 is useful for smoothing compound over large surface areas as opposed to drywall joints or cracks, and for feathering, spackling and finishing of compound spreading particularly for great surface areas.

Figure 7:
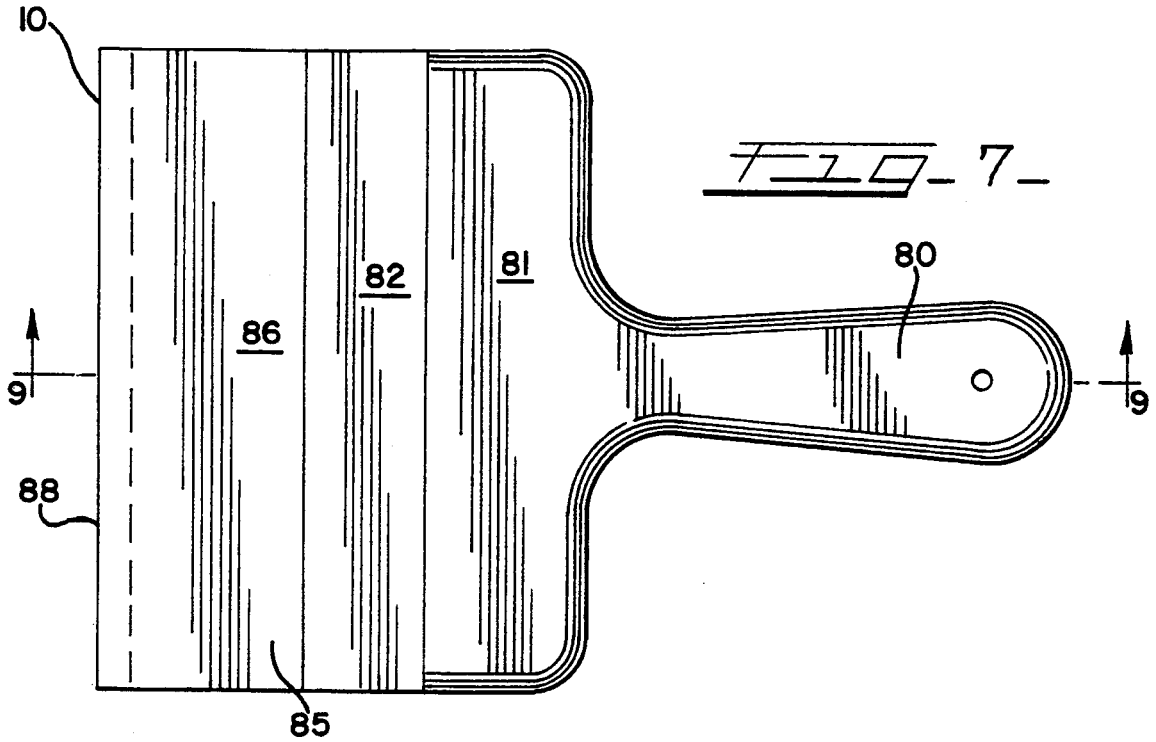
FIG. 7 is a bottom plan view of an alternate embodiment of the present invention having blade members of variable rigidity but no crown or removable outer blade edge.
Figure 8:
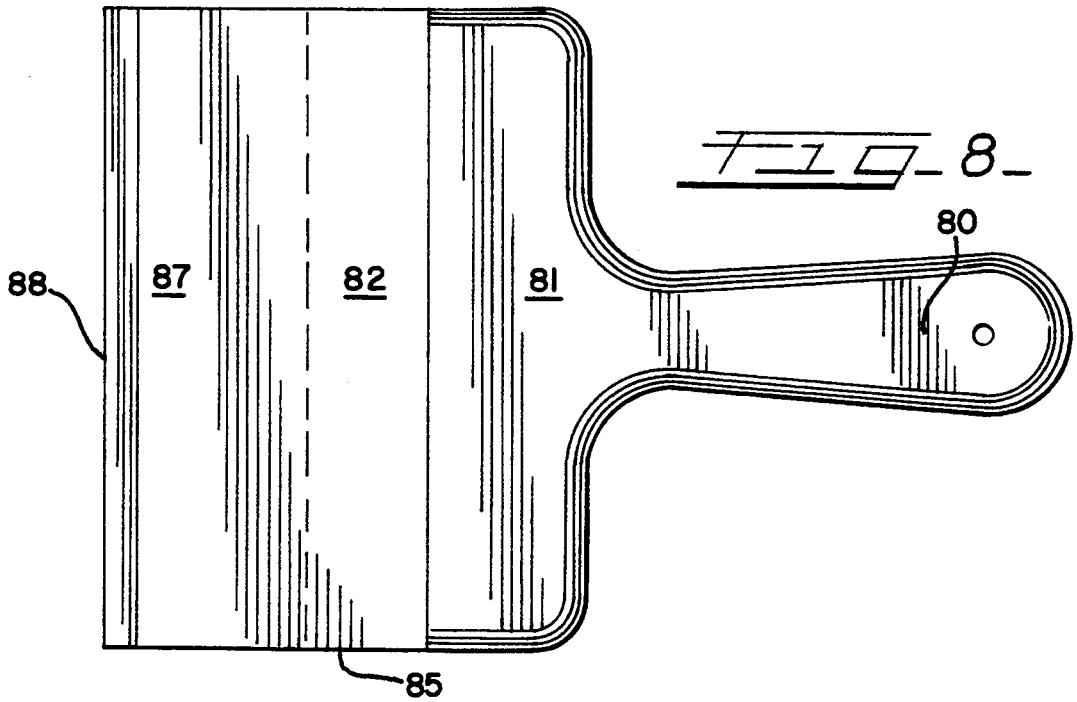
FIG. 8 is a top plan view of the embodiment of the invention depicted in FIG: 7.
Figure 9:
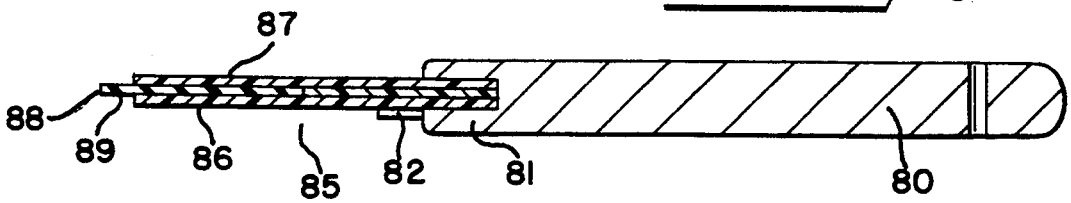
FIG. 9 is a side elevational view taken along line 9—9 of FIG. 7.

FIGS. 7–9 show a third alternate embodiment of the invention having a handle portion 80 formed in the conventional manner by which a hand may grip the tool 10. The front portion 81 of the handle 80 mounts the applicator 85 having an application face 86 formed of a resilient material, preferably flexible plastic affixed to a back face 87 formed of more rigid but still resilient material. A rigid member 82 is affixed to application face 86 for additional support. Said application face 86, back face 87 and rigid member 82 are fixedly mounted within the front portion 81 of the handle 80, as clearly shown in FIGS. 7–9. The outer edge end 88 of the applicator 85 is comprised of the edge end 89 of application face 86 which extends in length beyond back face 87 to form the flexible outer edge end 88.

When using the improved spreading tool of FIGS. 7–9, bonding compound or the like is first placed upon application face 86 of the applicator 85. Application face 86 then is placed against a planar surface such as drywall or, preferably for this embodiment, ceramic tile or wallpaper, and the handle 80 is used to force the tool 10 inward to exert pressure on the application face 86 and, in particular, the edge end 89. Thereafter, the tool 10 is dragged along the planar surface with sufficient pressure to cause the edge end 89 and application face 86 to force the bonding compound smoothly into place over and/or in crevices, joints or the like, of the planar surface, leaving a smooth finish without forming ridges or other interruptions of spread compound frequently formed by metal spreading tools.

Figure 10:
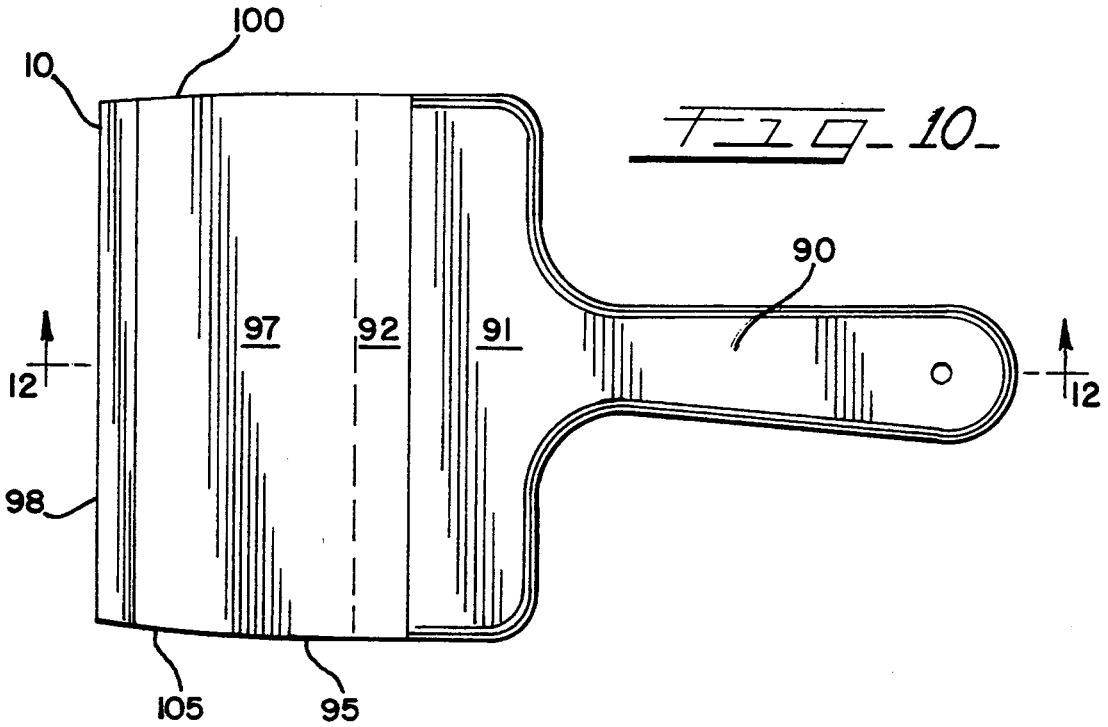
FIG. 10 is a top plan view of an alternate embodiment of the present invention showing a smaller scale improved spreader tool for patching having blade members of variable rigidity but no crown or removable outer blade edge.
Figure 11:
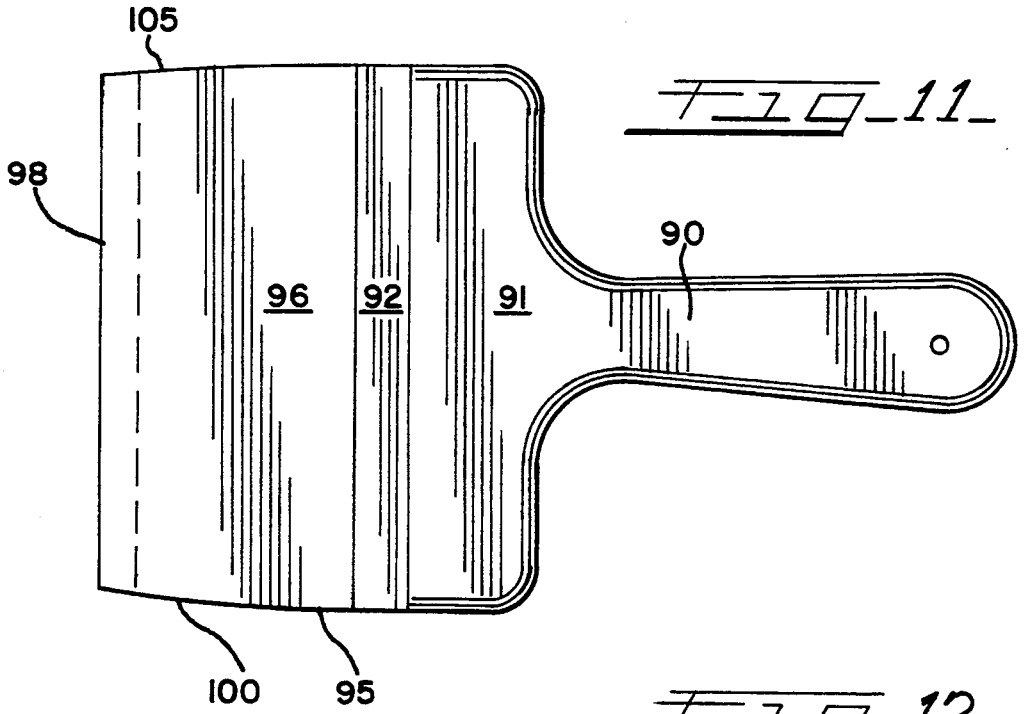
FIG. 11 is a bottom plan view of the embodiment of the invention depicted in FIG. 10.
Figure 12:
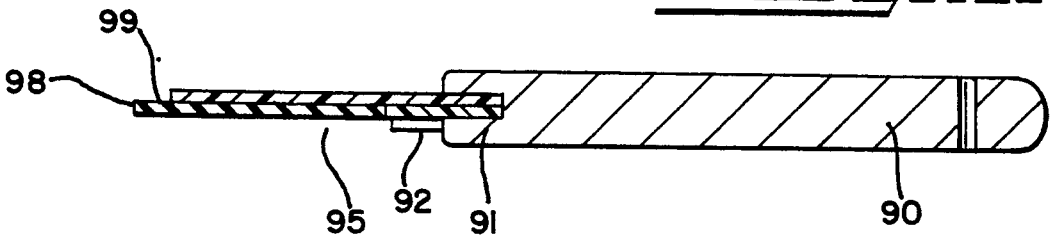
FIG. 12 is a side elevational view taken along line 12—12 of FIG. 10.

FIGS. 10—12 show a fourth alternate embodiment of the invention similar to the embodiment shown in FIGS. 7–9 but smaller and tapered particularly for spackling, patching, wallpapering, and grouting work. In this embodiment, the tool 10 has a handle portion 90 formed in a conventional manner by which a hand may grip the tool 10. The front portion 91 of the handle 90 mounts the applicator 95 having base application section 96 formed of resilient material, preferably flexible plastic. A rigid member 92 is affixed to the base application section 96. Rigid member 92 and base application section 96 are fixedly mounted within the front portion 91 of the handle 90, as clearly shown in FIGS. 10–12. The outer edge end 98 of the applicator 95 is comprised of the edge end section 99 forming a flexible outer edge having a smaller width than the remainder applicator 95 by virtue of tapers 100 and 105 of the applicator 95. Edge end section 99 of applicator 95 is preferably made of a resilient material that is more flexible and softer than base application section 96. In effect, applicator 95 is merely a flat blade having two sections. Two different plastic recipes will be used and the two sections will be either bonded or interlocked together at joint 97 to appear as a simple flat blade with edge end section 99 being more flexible than the rest of applicator 95. Joint 97 can be any suitable joint to connect base application section 96 and end edge section 99. For example, joint 97 may be a flat joint, a simple notch and groove, a step shaped joint, etc. The tool 10 shown in FIGS. 10–12 is [modified in size and shape] compared to the tool 10 of FIGS. 7–9, but has similar advantages, properties and methods of use as that disclosed above for tool 10 of FIGS. 7–9.

While specific embodiments of the invention have been shown and described, it is to be understood that numerous changes, alterations and modifications thereof may be made without departing from the scope, spirit, and intent of the invention as defined in the appended claims.

What is claimed is:

1. An improved tool for spreading bonding compound on planar surfaces, said tool having a main body portion comprised of an applicator for carrying and spreading compound to be applied to a planar surface, and a handle for gripping said tool, said applicator having a spreader end, a handle end and two side ends, said applicator fixedly mounted to said handle at said handle ends, said improvement comprising:

a rigid back face, an applicator face, and a curved outer edge end forming said applicator in a single piece construction; and a flexible applicator edge disposed at said outer edge end of said applicator and having means for removably and interlockably attaching said flexible applicator edge to said outer edge;

wherein said flexible applicator edge is curved to be insertable into said outer edge end and assumes a substantially curved shape when not forced into contact with said planar surfaces and wherein said flexible applicator edge assumes a substantially linear shape when forced into contact with and dragged along said planar surfaces by said handle with said applicator face forcing said compound out towards said side ends to evenly distribute said compound on said planar surfaces.

2. The spreading tool according to claim 1, wherein said applicator edge is formed of resilient non-metal material.

3. The spreading tool according to claim 1, wherein said applicator edge is formed of resilient metal.

4. The spreading tool according to claim 1, wherein said flexible applicator edge extends beyond said rigid back face.

5. The spreading tool according to claim 4, wherein said extension of said flexible applicator edge ranges from 0.25 inches to 1 inch.

6. The spreading tool according to claim 1, wherein said applicator has a concave curvature forming a center crown along said flexible applicator edge.

7. The spreading tool according to claim 1, wherein said applicator has a concave curvature forming an off-center crown along said flexible applicator edge toward one of said side ends.

8. An improved tool for spreading bonding compound on planar surfaces, said tool having a handle portion, and a main body portion with an applicator formed of and comprising a curved edge portion, a pair of side ends, a handle end, and a pair of contoured faces each having a curvature starting at one side end of said applicator and continuing toward the center portion of said applicator, said improvement comprising:

said applicator being formed of a single-piece construction;

a flexible outer edge removably and interlockably affixed to said edge portion; and wherein said flexible outer edge is curved to be insertable into said outer edge portion and assumes a substantially curved shape when not forced into contact with said planar surfaces and wherein said flexible outer edge assumes a substantially linear shape when forced into contact with and dragged along said planar surfaces by said handle with said applicator face forcing said compound out towards said side ends to evenly distribute said compound on said planar surfaces.

9. The spreading tool according to claim 8, where said applicator has a concave curvature forming a center crown, with the center of said curvature originating at a bisecting plane of said faces, and wherein said outer edge is formed of resilient material to assume said concave curvature of said applicator when cooperatively associated with said edge portion.

10. The spreading tool according to claim 8, wherein said applicator is fixedly secured to said handle portion which extends longitudinally from said main body portion, said center of curvature of each of said faces lying substantially within a plane bisecting said handle portion along the longitudinal direction thereof.

11. The spreading tool recited in claim 8, wherein said main body portion is made of a rigid plastic and said outer edge is made of resilient plastic.

12. The spreading tool recited in claim 11, wherein the curvature of said applicator is such that the angle subtended by a pair of tangents, one tangent lying parallel to said center of curvature of said applicator and the other tangent lying parallel to one of said side ends thereof being within the range of between 3 degrees and 15 degrees.

13. The spreading tool recited in claim 8, wherein said main body portion and said outer edge are made of a flexible metal.

14. The spreading tool of claim 1, wherein said outer edge end of said applicator comprises a generally parallel long arm section and short arm section forming a cavity therebetween.

15. The spreading tool of claim 14, wherein said flexible applicator edge is of generally linearly stepped configuration and is partially received in said cavity.

16. The spreader tool of claim 14, wherein said flexible applicator edge is of generally Y-shaped configuration and is partially received in said cavity.

17. The spreading tool of claim 8, wherein said means for cooperatively associating said flexible outer edge with said edge portion comprises a generally parallel long arm section and short arm section defining said edge portion and forming a cavity therebetween for partially receiving said flexible outer edge.

18. The spreading tool of claim 17, wherein said flexible outer edge is of generally linearly stepped configuration.

19. The spreader tool of claim 17, wherein said flexible outer edge is of generally Y-shaped configuration.

* * * * *